United States Patent [19]

Hashimoto

[11] Patent Number: 5,076,452

[45] Date of Patent: Dec. 31, 1991

[54] PLASTIC RECEPTACLE

[75] Inventor: Kentaro Hashimoto, Tokyo, Japan

[73] Assignee: Tokyo Glass Seiki Kabushiki Kaisha, Tokyo, Japan

[21] Appl. No.: 517,173

[22] Filed: May 1, 1990

[51] Int. Cl.[5] ..... B65D 25/46

[52] U.S. Cl. ..... 215/1 A; 215/1 C; 215/32; 229/103.1; 222/572

[58] Field of Search ..... 215/1 A, 1 C, 32, 31; 222/95, 107, 212, 572; 229/108.1

[56] References Cited

U.S. PATENT DOCUMENTS

| | | | |
|---|---|---|---|
| 3,128,016 | 4/1964 | Ferri, Jr. | 222/107 X |
| 3,155,281 | 11/1964 | Stracey | 222/107 |
| 3,182,861 | 5/1965 | Nataf | 222/212 |
| 3,187,966 | 6/1965 | Klygis | 222/212 X |
| 3,347,401 | 10/1967 | Nataf | 229/103.1 X |
| 3,949,871 | 4/1976 | Christensen et al. | 222/107 X |
| 4,572,412 | 2/1986 | Brach et al. | 222/572 X |
| 4,982,854 | 1/1981 | Ichemiya | 215/1 C X |

FOREIGN PATENT DOCUMENTS

| | | | |
|---|---|---|---|
| 1435985 | 3/1966 | France | 215/32 |
| 657432 | 11/1963 | Italy | 215/32 |
| 1161745 | 8/1969 | United Kingdom | 215/32 |

*Primary Examiner*—Sue A. Weaver

*Attorney, Agent, or Firm*—Oblon, Spivak, McClelland, Maier & Neustadt

[57] ABSTRACT

A plastic beverage container is formed from a tubular blank and has a lower portion formed in a bottle-like shape and an upper portion which includes a gradually diametrically reduced bellows tube. The upper portion further comprises a mouth tube with a smaller diameter than the bellows tube with the upper portion of the mouth tube forming a small tube with a smaller diameter than the mouth tube. The upper portion of the small tube forms a fine tube with a smaller diameter than the small tube with a thin walled junction formed between the small tube and the mouth tube. The small tube is provided with a pair of outwardly extending twist vanes to permit the tube to be broken at the thin walled junction for consumption of the beverage.

2 Claims, 3 Drawing Sheets

PLASTIC RECEPTACLE

DETAILED DESCRIPTION OF THE INVENTION

This invention relates to a plastic receptacle with a juice or other kinds of liquid sealed therein or particularly a blow molded receptacle of the type.

Plastic receptacles of the type in question have been formed from a soft-plastic elongate tubular blank introduced between a pair of molds and blown in the mold cavity thus formed.

In order to fill the type of plastic receptacles with juice or other kinds of liquid, the latter is allowed to flow in through a fine tube extending upwards of a mouth of the receptacle, and thence the fine tube is fuse closed for transportation and marketing.

When the content of the type of receptacles is to be used, the fine tube has to be cut open normally between the teeth of a user without scissors or cutter blade at hand. The biting operation in usual occasions will cause splash of the content or other undesirable implications.

The general object of the invention is to provide a receptacle imparted with the capability of being cut open at the mouth portion without resort to scissors or separate cutting tools, while the mouth is not susceptible to inadvertent opening during transportation and display for marketing.

To attain this object, the invention provides a plastic receptacle formed from a tubular blank of a soft plastic being introduced between a pair of mold halves and blow molded in the mold cavity comprising a receptacle body (1) having an approximately two thirds lower portion formed in a bottle-like shape (2) whose upper portion forms a gradually diametrically reduced bellows tube (3) whose upper portion forms a mouth tube (4) with a smaller diameter than a maximum diameter of the bellows tube (3), the upper portion of said mouth tube forms a small tube (5) with a smaller diameter than a maximum diameter of the mouth tube, the upper portion of the small tube (5) forms a fine tube (6) with a smaller diameter than a maximum diameter of the small tube (5), the junction between said small tube (5) and said mouth tube (4) being formed by a fairly small thickness wall (7), and said small tube (5) being provided with a pair of twist vanes (8) protruding bilaterally in the radial outward directions.

After the receptacle has its bottle-like shaped portion (2) filled with juice or other liquid through the fine tube (6) it will be transported and offered to market.

As the content of the receptacle (1) is to be drunk, the pair of twist vanes (8) protruding bilaterally in the radial outward directions of said small tube (5) will be engaged with the thumb and the finger of a drinker and thereby turned in clockwise or anticlockwise direction thereby to twist and tear open the junction (7) formed between the small tube (5) and the mouth tube (4) in fairly small thickness wall whereby a sucking opening will be exposed in the center of mouth tube (4). The content thus may be drunk from the mouth tube (4) in the mouth.

The bellows tube (3), as the twist vanes (8) are turned, will make a turning at a small direction and then be applied with a restoration force in the opposite direction to the twisting direction of the vanes due to the configuration thereof. In other words, a twisting force at the vanes (8) and a restoration force of the bellows tube (3) will synergetically achieve the cutting operation of the receptacle mouth, thus reducing a necessary degree of twisting force for the cutting operation. The wall thickness in the junction (7) between the small tube (5) and mouth tube (4) should not be extremely small, but great enough to a degree immunizing the junction from any mechanical impacts which the receptacles are exposed during transportation and marketing. Despite of the greatness of the wall thickness of the junction (7), the synergy of the twisting force at the vanes (8) and the restoration force of the bellows tube (3) provides a sufficient degree of cutting force of the thickness junction (7).

The provision of bellows tube (3), small diametrical mouth tube (4), small tube (5) and fine tube (6), and twist vanes (8) will reinforce the receptacle overall and impart a good appearance thereto.

The invention has other many advantages and functions which will be clear in the following description of an embodiment.

An embodiment of the invention is shown in attached drawings.

Figure 1:
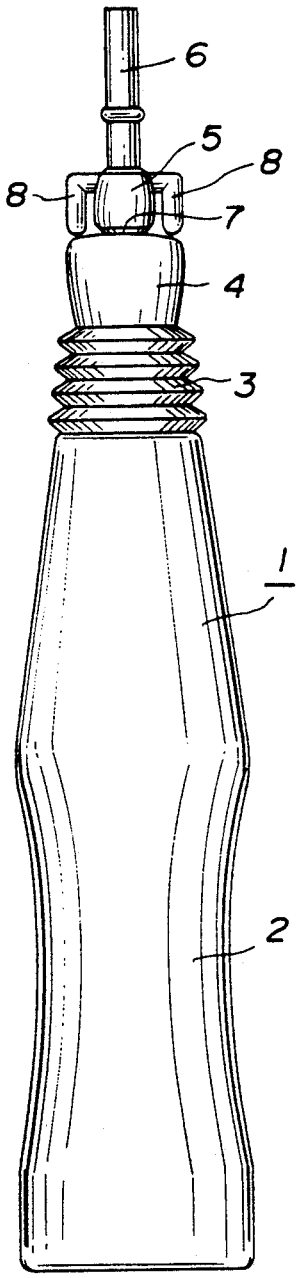
FIG. 1 shows an overall front view of the embodiment.
Figure 2:
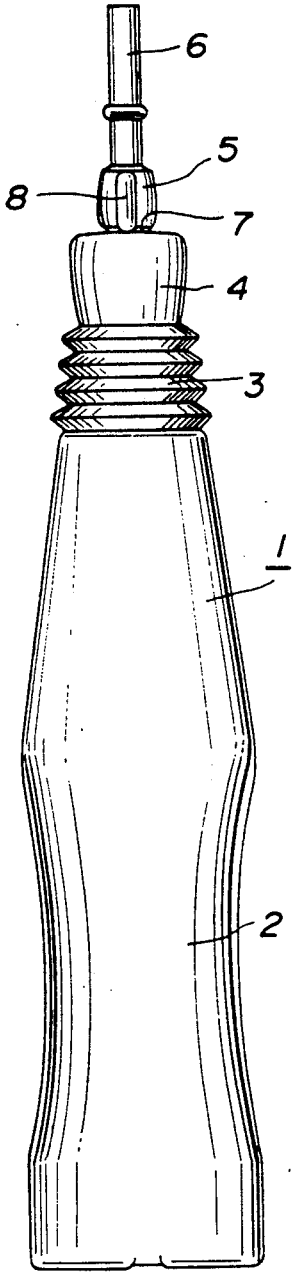
FIG. 2 shows a lateral view thereof.
Figure 3:
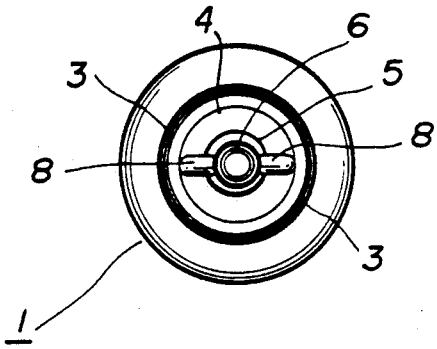
FIG. 3 shows a top view thereof.
Figure 4:
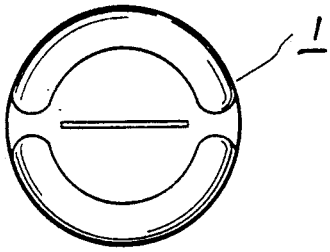
FIG. 4 shows a bottom view thereof.
Figure 5:
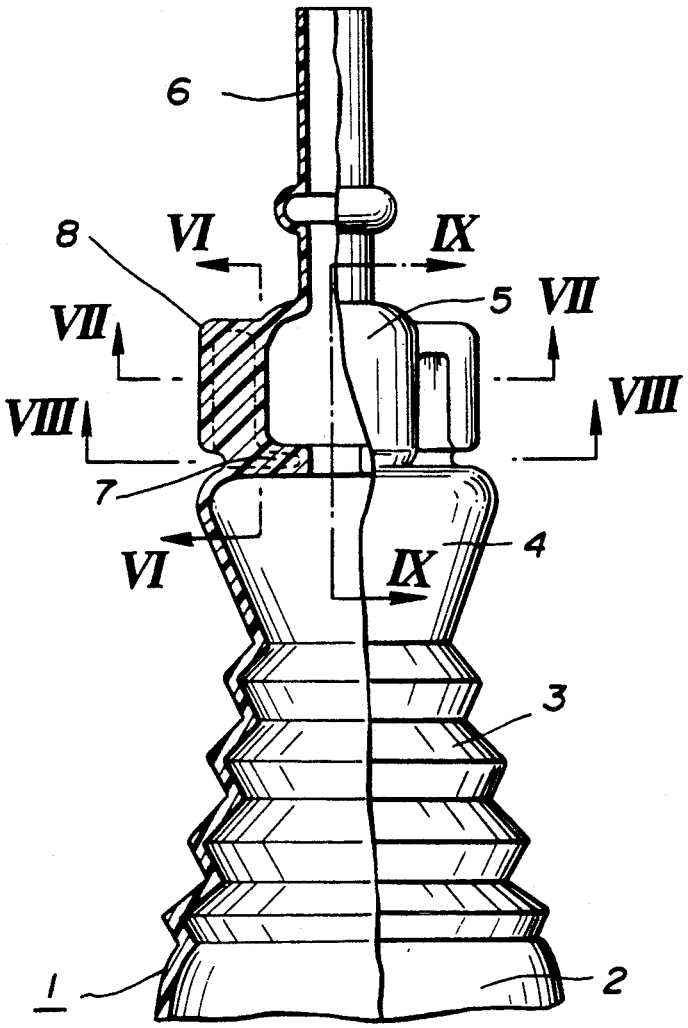
FIG. 5 shows an enlarged view of the critical portions thereof.

The invention will now be described with reference to the shown embodiment.

Reference numeral 1 designates a receptacle body whose about two thirds lower portion is shaped in a bottle like shape (2). Reference numeral 3 designates a bellows tube (3) extending from the bottle shape (2) and having a gradually smaller diameter. The upper portion of the bellows tube (3) extends as a mouth portion (4) with a smaller diameter than a maximum diameter of the bellows tube (3). Desirably, the mouth portion (4) may be of a size suitable for introduction into a human mouth.

At the upper portion of the mouth tube (4) extends a small tube (5) with a smaller diameter. The small tube (5) has a fine tube (6) at the upper portion thereof.

The small tube (5) and the mouth tube (4) have a small thickness portion (7) at the junction thereof. The small tube (5) is provided with a pair of twist vanes (8) bilaterally protruding in the radial directions thereof. The vanes are formed, as shown, by a relatively great thickness wall and in a horizontal flat form.

Figure 6:
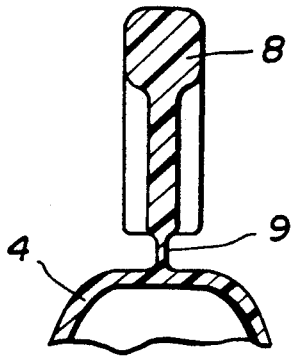
FIG. 6 shows an enlarged section taken along line VI—VI of FIG. 5.
Figure 9:
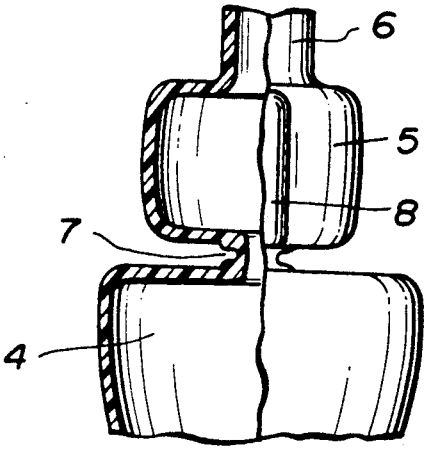
FIG. 9 shows an enlarged section taken along line IX—IX of FIG. 5.
Figure 7:
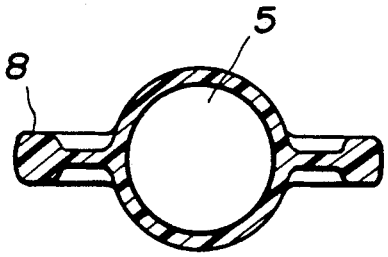
FIG. 7 shows an enlarged section taken along line VII—VII of FIG. 5.
Figure 8:
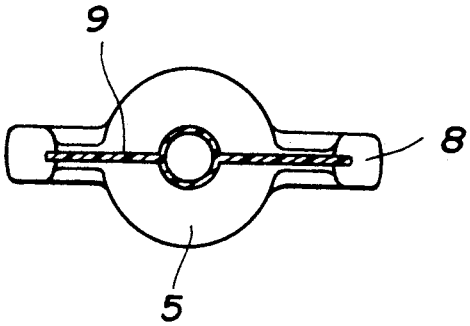
FIG. 8 shows an enlarged section taken along line VIII—VIII of FIG. 5.

The lower ends of vanes (8) are located in proximity with the upper face of the mouth tube (4). Alternatively, a very small thickness wall junction (9) may be, as depicted in FIG. 6, formed between the lower end of the vanes (8) and upper face of the mouth tube (4).

The receptacle may be continuously formed by a molding machine called a blow molding machine where a soft plastic elongate tubular blank is introduced and loaded between a pair of molds and blown in the mold cavity formed by molds and closed by a suitable means.

Specifically, the fine tube (6) has a thickness as great as the elongate blank, small tube (5), mouth tube (4), bellows tube (3) and receptacle body (1) have their respective thicknesses smaller one than another and their respective diameters greater one than another in this order.

When the fine tube (6) and the small tube (5) are cut away, they should have a relatively great degree of thickness and should have a relatively high degree of rigidity. The blow molding method above mentioned may impart these favorable physical properties to the fine tube and the small tube. The bellows tube (3) is molded in a thickness imparting a good softness for exerting a restoration force against twisting force. The receptacle body may have a relatively small thickness and may be thus squeezable in the user's hand to squeeze out the content.

In use, as the content of the receptacle (1) is to be drunk, the pair of twist vanes (8) protruding bilaterally in the radial outward directions of said small tube (5) will be engaged with the thumb and the finger of a drinker and thereby turned in clockwise or anticlockwise direction thereby to twist and tear open the junction (7) formed between the small tube (5) and the mouth tube (4) in fairly small thickness wall whereby a sucking opening will be exposed in the center of mouth tube (4). The content thus may be drunk from the mouth tube (4) in the mouth.

The bellow tube (3), as the twist vanes (8) are turned, will make a turning at a small direction and then be applied with a restoration force in the opposite direction to the twisting direction of the vanes due to the configuration thereof. In other words, a twisting force at the vanes (8) and a restoration force of the bellows tube (3) will synergetically achieve the cutting operation of the receptacle mouth, thus reducing a necessary degree of twisting force for the cutting operation.

The invention should not be construed to the described embodiment, but is defined in the attached claim encompassing a variety of embodiments and variations.

What is claimed is:

1. A blow-molded soft plastic receptacle comprising:
   - a receptacle body having a lower portion formed in a bottle-like shape;
   - an upper portion forming a mouth tube having a sucking opening therein;
   - a removable top portion joined with said mouth tube by a fairly small thickness wall surrounding said sucking opening;
   - twisting means on said removable top portion for transferring a twisting force to said removable top portion; and
   - restoring means for providing a restoring force to said mouth tube in response to the twisting force transferred by said twisting means, wherein said means for providing a restoring force comprises a bellow tube, and whereby said twisting force and restoring force act synergetically on said fairly small thickness wall to achieve a cutting or tearing of said fairly small thickness wall.

2. A blow-molded soft plastic receptacle as recited in claim 1, wherein said twisting means comprises a pair of twist vanes attached to said removable top portion.

* * * * *